United States Patent [19]

O'Neal

[11] Patent Number: 4,566,288

[45] Date of Patent: Jan. 28, 1986

[54] ENERGY SAVING HEAD PRESSURE CONTROL SYSTEM

[76] Inventor: Andrew W. O'Neal, 18517 8th Ave. NE., Seattle, Wash. 98155

[21] Appl. No.: 640,022

[22] Filed: Aug. 9, 1984

[51] Int. Cl.[4] ..... F25B 41/00

[52] U.S. Cl. ..... 62/196.1; 62/117; 62/DIG. 17

[58] Field of Search ..... 62/DIG. 17, 183, 196.1, 62/117, 509

[56] References Cited

U.S. PATENT DOCUMENTS

| | | | |
|---|---|---|---|
| 1,790,237 | 1/1931 | King . | |
| 2,934,911 | 5/1980 | Micai et al. | 62/117 |
| 2,963,877 | 12/1960 | Malkoff et al. | 62/196 B |
| 3,060,699 | 10/1962 | Tilney | 62/196 |
| 3,103,795 | 9/1963 | Tilney | 62/196 B |
| 3,389,576 | 6/1968 | Mauer | 62/183 X |
| 3,438,217 | 4/1969 | Leimbach | 62/196 |
| 3,905,202 | 9/1975 | Taft et al. | 62/152 |
| 3,939,668 | 2/1976 | Morris | 62/117 X |
| 3,988,904 | 11/1976 | Ross | 62/174 |
| 4,068,494 | 1/1978 | Kramer | 62/196 B |
| 4,120,173 | 10/1978 | Kimpel | 62/181 |
| 4,136,528 | 1/1979 | Vogel et al. | 62/174 |
| 4,193,781 | 3/1980 | Vogel et al. | 62/81 |
| 4,328,682 | 5/1982 | Vana | 62/196 B |
| 4,373,348 | 2/1983 | Ibrahim et al. | 62/115 |
| 4,457,138 | 7/1984 | Bowman | 62/DIG. 17 X |

*Primary Examiner*—William E. Wayner

*Attorney, Agent, or Firm*—Seed and Berry

[57] ABSTRACT

A control system for a compression type refrigeration unit with an air-cooled condenser exposed to outside ambient conditions. In cooler weather the head pressure is maintained by backflooding the condenser which limits the condensing surface. This also subcools the liquid in the condenser. A bypass line from a point between the outlet of the condenser and the receiver inlet connects with the liquid supply line leaving the receiver and directs this subcooled liquid to the expansion valve. A solenoid valve in the bypass line is controlled by a liquid level sensor or subcooling sensor in the line leaving the condenser. This increases the capacity of the evaporator as less evaporation is required to remove the sensible heat-down to the evaporating temperature. In warmer weather, the system automatically reverts to a conventional condensing mode.

33 Claims, 2 Drawing Figures

ENERGY SAVING HEAD PRESSURE CONTROL SYSTEM

DESCRIPTION

1. Technical Field

The present invention relates to an improved refrigeration system which automatically maintains the head pressure of the system during colder weather by flooding the condenser and which diverts subcooled liquid from the condenser directly to the expansion valve, when subcooled liquid is available. In warmer weather, the system automatically reverts to a conventional condensing mode.

2. Background Art

In a conventional refrigeration system, the capacity of an air-cooled condenser is proportional to the temperature difference between the condensing temperature of the refrigerant and the ambient air temperature entering the condenser. Since such a condenser is selected to operate efficiently at a temperature difference suitable for summer temperature conditions (when the ambient temperature is relatively high), the capacity of the condenser will increase substantially when it is operated at winter conditions having a relatively low ambient temperature. The usual result of this increase in condenser capacity is a reduction in the overall system head pressure. Such a pressure drop often results in flashing of the refrigerant to a gaseous state in the liquid supply line feeding the expansion valve. In these colder ambient conditions, a head pressure control is required, if the refrigeration system is to operate efficiently. Many controls have been suggested, including controlling the amount of ambient air passing through the condenser by cycling the fans or by controlling the speed of the fan motors. Alternatively, dampers have been used to limit the airflow. Back-flooding of the condenser also achieves head pressure control. Many control systems have been proposed or are in use, such as those systems described in U.S. Pat. Nos. 2,934,911; 2,954,681; 2,986,899; 2,963,877; 3,905,202; 4,068,494; and 4,373,348.

Back-flooding of the condenser results in subcooling of the liquid refrigerant which is stored in the condenser. While subcooling presents an opportunity for more efficient operation of the refrigeration system at a resultant lower head pressure, the value of this subcooled liquid is usually lost because the subcooled liquid is mixed with the discharge gas at the head pressure control valve prior to the receiver or is mixed with the discharge gas being diverted to the receiver. Although some systems use this subcooled liquid by bypassing the receiver during colder ambients, these prior art systems retain the problem of controlling uncondensed gas passing from the condenser directly to the expansion valve in warmer ambients. Because expansion valves are designed to operate with a fully liquid refrigerant at their inlets, any uncondensed gas in the supply line to the expansion valve will reduce the effectiveness of the expansion valve and will result in poor refrigeration throughout the system, since insufficient liquid refrigerant reaches the expansion valve.

Dealing with this problem, U.S. Pat. No. 3,905,202 suggests a subcooler in the supply line just prior to the expansion valve to condense any flash gas. Such a system, however, requires additional compressor capacity. U.S. Pat. No. 4,328,682 suggests placing a solenoid valve to divert discharge pressure to the top of the receiver and thereby to back-flood liquid from the receiver to the condenser. Such a system can at times raise the head pressure above the normal head pressure of the system and thereby decrease the system's efficiency since greater compression is required. Finally, U.S. Pat. No. 4,068,494 suggests charging refrigerant to the system until the receiver is completely filled and until liquid refrigerant backs up into the condenser to maintain a liquid seal throughout this portion of the system. In such a circumstance, there is little space available in the condenser for pump-down and a high condensing pressure can result. Again, efficiency is reduced.

DISCLOSURE OF INVENTION

When a compression-type refrigeration system having an air-cooled condenser exposed to outside ambient conditions is operated in cooler weather, the head pressure of the system is maintained by back-flooding the condenser, thereby limiting the condensing surface of the condenser. Back-flooding results in subcooled liquid refrigerant in the condenser. A bypass line for subcooled refrigerant exits the bottom of the condenser and diverts the subcooled liquid refrigerant directly to the supply line for the expansion valve. Such a shunt increases the capacity of the evaporator since less evaporation is required to remove the sensible heat of the refrigerant to its evaporating temperature. In warmer weather, however, the refrigeration system automatically reverts to a conventional condensing mode, as will be explained.

The refrigeration system of the present invention includes a closed refrigerant loop having a condenser, a receiver, an expansion device (usually an expansion valve), an evaporator, and a compressor. The system further includes suitable means for automatically maintaining an adequate head pressure for the system during colder weather, having a liquid refrigerant shunt for shuttling liquid refrigerant from the receiver to the condenser to maintain head pressure for the system.

The preferred system also includes another shunt for diverting subcooled liquid refrigerant from the condenser directly to the expansion device, thereby bypassing the receiver. This second shunt is responsive to the level of liquid refrigerant in a reservoir connected between the condenser and the receiver.

In some circumstances, it is desirable to include a pressure equalizer between the condenser and receiver to prevent the migration of liquid refrigerant from the receiver to the condenser during an off cycle. Such a mechanism includes a spring-biased equalizing valve prior to the receiver in a bypass line in parallel with the output pressure regulating (OPR) valve. This equalizing valve is normally closed by the pressure of the compressor. During an off cycle, however, the equalizing valve is spring-biased open so that the discharge pressure of the receiver and the pressure of the condenser can substantially equalize.

Another novel feature of the invention includes a mechanism for allowing an overall drop in the condenser and system pressure when feeding subcooled liquid refrigerant to the expansion valve. This mechanism is responsive to flashing occurring prior to the expansion valve, and generally includes a chamber in the supply line to detect flashing with suitable detection means.

These and other novel features of the invention will be better understood by reference to the following drawings and detailed description.

BEST MODE FOR CARRYING OUT THE INVENTION

Figure 1:
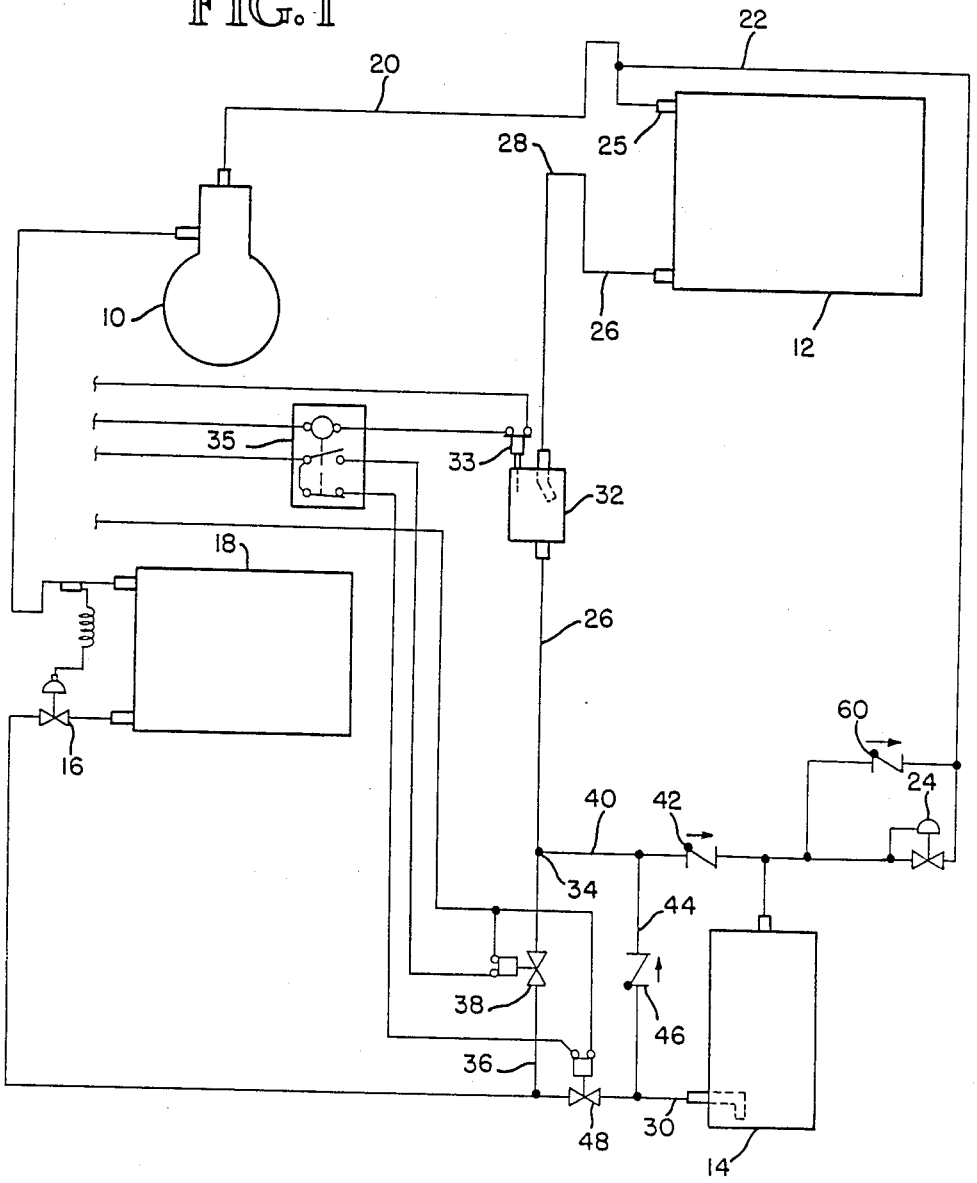
FIG. 1 is a schematic block diagram of a preferred refrigeration system incorporating the control means of the present invention.

In a compression-type refrigeration system having an air-cooled condenser exposed to outside ambient conditions, the conventional elements are included, namely, a compressor 10, a condenser 12, a receiver 14, an expansion valve 16, and at least one associated evaporator 18 interconnected into a closed refrigerant loop. Ordinarily, the high pressure supply line 20 linking the compressor to the condenser includes a bypass line 22 above the condenser inlet 25 to divert discharge gas through an adjustable outlet pressure regulating (OPR) valve 24 into the top of the receiver 14. The OPR valve 24, which opens on a drop of outlet pressure, in part controls the overall system head pressure.

Generally, gaseous refrigerant enters the top of the condenser 12 through condenser inlet 25 and is liquified in full or in part by the flow of ambient air through the condenser. The refrigerant exits the condenser 12 through refrigerant line 26 and proceeds through a trap 28 positioned to maintain liquid refrigerant in the condenser 12 during an off cycle. In normal operation, the refrigerant is directed from the condenser 12 immediately to the top of the receiver 14. In the system of the present invention, an altered flow pattern is possible, as will be explained in greater detail.

The receiver 14 ensures separation of gaseous and liquid refrigerant. A supply line 30 at the bottom of the receiver 14 conveys liquid refrigerant to the expansion valve 16, which meters the flow of refrigerant to the evaporators 18, as is conventional.

In the refrigerant line 26, after the trap 28, a reservoir 32, having a volume of about 1/20 the volume of the receiver 14, is placed as a control. The refrigerant line 26 continues to a three-way junction or "T" 34 defining two flowpaths.

One flowpath through line 36 connects with the supply line 30 for directing refrigerant directly to the expansion valve 16, thereby bypassing the receiver 14. Line 36 includes a solenoid valve 38, which is normally closed. This valve 38 is opened in response to the level of liquid refrigerant in the reservoir 32, while a valve 48 in supply line 30 is closed. That is, when the level of liquid refrigerant in the reservoir 32 reaches a predetermined level, as measured by a level sensor 33, such as a thermistor 33, (the Fenwal Electronics EMC-6B1983 thermistor) or by a hermetically sealed float switch assembly (such as a Refrigeration Specialties Company float switch), a control system operates the valves 38 and 48. The control system preferably includes a relay 35 triggered by the thermistor. The relay 35 has a pair of normally open—normally closed contacts to activate the valve 38 and to deactivate valve 48 accordingly. When the valve 38 is open, subcooled liquid refrigerant in the condenser 12 may pass directly to the expansion valve 16. The control system described can also be accomplished with a subcooling sensing device in line 26 instead of the liquid level sensor 33. Such a sensing device is described in U.S. Pat. No. 4,193,781.

The three-way junction 34 also includes a second flowpath having a feeder line 40 including a one-way check way 42 directing refrigerant from the refrigerant line 26 into the top of the receiver 14. That is, the check valve 42 restricts flow in line 40 to the direction leading toward the receiver 14. A shuttling line 44 joins with line 40 between the check valve 42 and three-way junction 34 to allow liquid refrigerant to pass from the bottom of the receiver 14 either directly from the receiver or from the supply line 30 through a check valve 46 into line 40, into refrigerant line 26, and back into the condenser 12. Liquid refrigerant will flow from the bottom of the receiver 14 to the condenser 12 when the OPR valve 24 opens.

When liquid refrigerant in the receiver 14 flows back to the condenser 12, the condensing surface available within the condenser 12 is reduced. Such back-flooding maintains the head pressure of the system within a predetermined desirable range.

As previously explained, when the liquid refrigerant passes backward to the condenser, the liquid refrigerant fills the reservoir 32. When the reservoir 32 is filled to a predetermined level, a sensor 33 detects the presence of liquid refrigerant in the reservoir 32 and actuates the solenoid valve 38 to allow shunting of liquid refrigerant from the condenser directly to the expansion valve. This liquid refrigerant is subcooled, and its bypassing the receiver 14 increases the system's efficiency.

The liquid level within the condenser 12 is controlled by the set point for the OPR valve 24. Any lowering of the level of liquid in the condenser 12 and subsequent lowering of the condensing pressure is compensated for by the OPR valve 24, which opens and forces liquid to flow back from the receiver 14 to the condenser 12. With a constant load on the refrigeration system, the level of liquid refrigerant in the condenser 12 will soon stabilize. During a pump-down or when one of several evaporators is deactivated by its liquid solenoid closing, any subsequent rise in condenser liquid level and condenser pressure will cause OPR valve 24 to close and excess liquid will flow through the check valve 42 back into the receiver 14.

The compressor 10 receives gaseous refrigerant from a suction line connecting the compressor 10 with the evaporator 18. The compressor 10 compresses the refrigerant to the condensing pressure and pumps the pressurized gas to the condenser 12. In ambient temperatures above about 50° F., a mixture of gas and liquid is conveyed through the condenser 12 and is directed through the refrigerant line 26, reservoir 32, three-way junction 34, feeder line 40, and check valve 42 to the top of the receiver 14. In this mode, since there is a combination of liquid and gas, the level of liquid refrigerant in the reservoir 32 is below the predetermined level so that the solenoid valve 38 is closed. In the receiver 14, the gaseous and liquid refrigerant are separated. Liquid refrigerant leaves the receiver 14 through the supply line 30 at the bottom of the receiver 14 and passes to the expansion valve 16. The OPR valve 24 closes on a rise of outlet pressure and, typically is set to close at about 50 or 60 psi, which is about 30 or 40 psi above the evaporating pressure of a system operating at about 20 psi or R12 refrigerant. In low temperature systems, the OPR valve 24 would have a lower setting, and, conversely, in higher temperature systems, the OPR valve 24 would have a higher setting. Other types of refrigerant would require different settings of the OPR valve. In most circumstances, the OPR valve 24 would be closed when the ambient temperature is above about 50° F. In cooler ambients, however, the OPR valve 24 opens to admit discharge gas from the bypass line 22 directly to the receiver 14. Due to a pressure drop in the condenser 12, liquid is forced from the receiver 14 back into the condenser 12. When the reservoir 32 is filled, the sensor 33 and associated control system causes solenoid valve 38 to open to allow shunting of subcooled refrigerant directly to the expansion valve 16, while simultaneously closing solenoid valve 48 in the supply line 30 between the shuttling line 44 and shunt line 36, to eliminate the flow of refrigerant from the receiver 14 to the expansion valve 16. In this way, the subcooled refrigerant of the condenser 12 is optimally used to gain its maximim cooling benefit.

The liquid refrigerant fills the condenser tubes to a level where the condensing surface is limited so that the head pressure equals the set pressure of the OPR valve 24.

The trap 28 in the refrigerant line 26 should be about one-half to two-thirds the height of the condenser 12. The purpose of the trap 28 is to allow liquid refrigerant to remain in the condenser 12 during an off cycle of the refrigeration system. If liquid remains in the condenser 12, this liquid facilitates faster head pressure build-up upon restart. In warm weather, this liquid refrigerant is quickly forced through the refrigerant line 26 when the system is started to enable a full condensing surface in the condenser 12.

A pressure equalizer 60 between the condenser 12 and receiver 14 prevents migration of liquid refrigerant from the receiver 14 to the condenser 12 during an off cycle. Such a mechanism includes a spring-biased equalizing valve atop the receiver 14 in the bypass line 22 from the compressor 10 to the OPR valve 24. The valve is normally closed by the compressor pressure, but is opened during a compressor 10 shutdown so that the pressure of the receiver 14 and the pressure of the condenser can substantially equalize.

Figure 2:
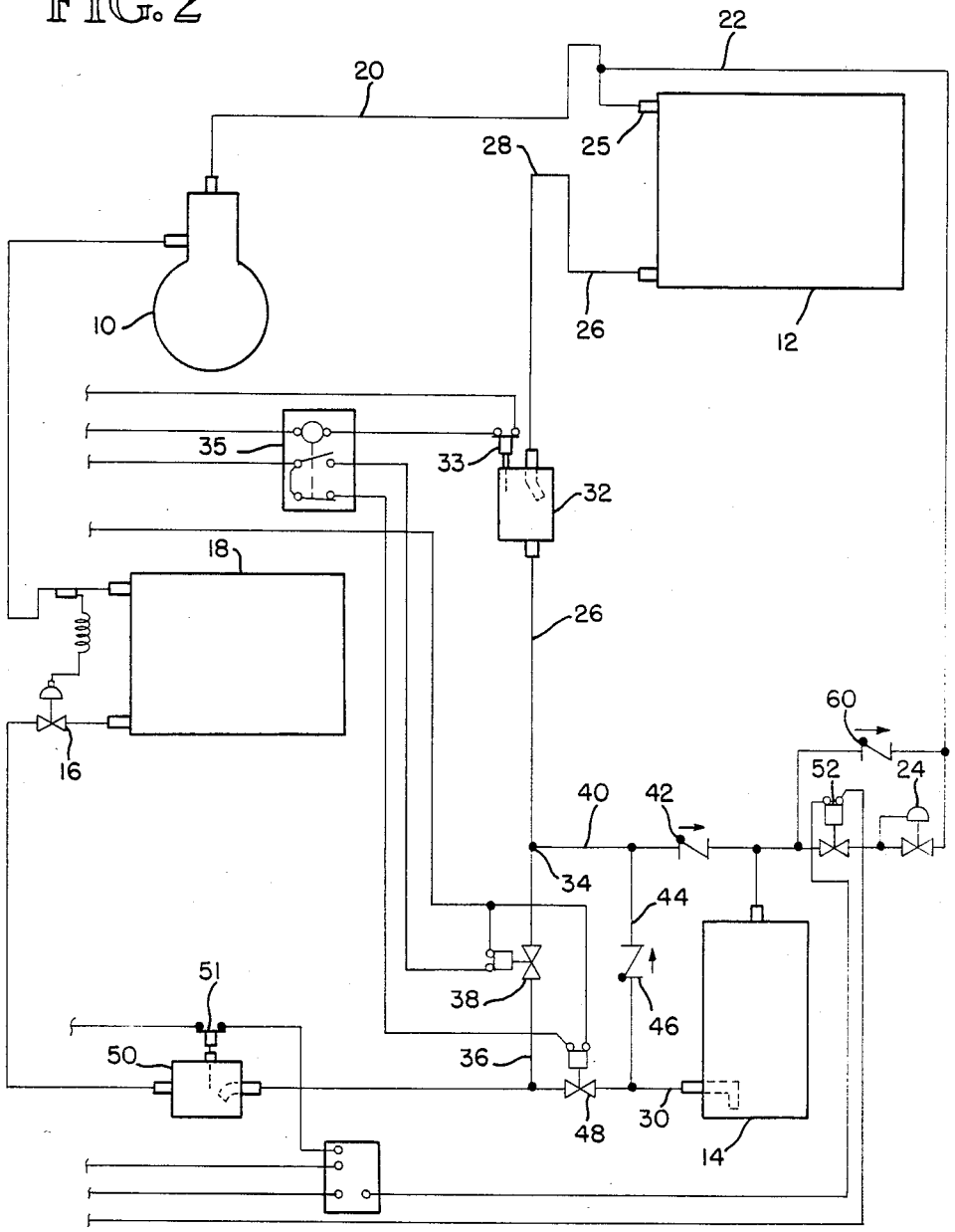
FIG. 2 is another schematic block diagram, similar to FIG. 1, including the mechanism for allowing a drop in condenser and system pressure when feeding subcooled liquid refrigerant to the expander.

In another embodiment of the refrigeration system, as shown in FIG. 2, the system further includes a second reservoir or chamber 50 between line 36 and the expansion valve 16 in the supply line 30 from the receiver 14 to the expansion valve 16. The chamber 50 includes a liquid refrigerant level sensor 51, as previously explained, to sense a predetermined level of liquid in the chamber 50 and to control a solenoid valve 52 placed between the outlet pressure regulating valve 24 and the receiver 14. This solenoid valve 52 is normally open. When the liquid level in the chamber 50 reaches its predetermined level, the solenoid valve 52 is closed, allowing the condenser pressure to fall below the setting of the OPR valve 24 since the closing of valve 52 fixes the pressure sensed by the OPR valve 24. That is, the subcooled liquid proceeding directly from the condenser 14 through solenoid valve 38 and line 36 allows a lower overall system pressure without flashing of liquid refrigerant before the expansion valve 16. The chamber 50 and level sensor 51 automatically allow more efficient, lower pressure operation which saves on compression. When the condenser pressure does drop, however, to a point where flashing of liquid refrigerant occurs prior to the expansion valve 16, the flashing is detected in chamber 50 by a lowering of the level of liquid refrigerant. The solenoid valve 52 is opened, allowing the OPR valve 24 to adjust the pressure.

In warmer weather, the system operates efficiently because the outlet pressure regulating valve 24 is closed. The condenser pressure is always above the set point of the valve 24. At this time, the opening or closing of the solenoid valve 52 has no effect on the system's performance. Any gaseous refrigerant occuring in the chamber 50 and allowing the solenoid valve 52 to be opened would arise from a shortage of liquid refrigerant whithin the refrigeration system. The opening of the solenoid valve 52 in warmer ambients could be used as a signal for recharging refrigerant to the system.

Generally, the receiver 14 is positioned as close as possible to the elevation of the condenser 12 to reduce the static head resisting flow of refrigerant from the receiver 14 to the condenser 12. In this way, the system becomes more sensitive to changes in the condenser head pressure.

Those skilled in the art will readily recognize modifications which may be made to the embodiments of the present invention without departing from their inventive concept, especially in the particular plumbing disclosed. For example, the shunt line from the condenser to the expansion valve may be completely independent from the refrigerant line leading to the top of the receiver. The shared pathway is preferred for its simplicity and effectiveness. The description and drawings illustrate the invention and are not intended to limit it, unless such limitation is necessary in light of the pertinent prior art. Therefore, the claims should be construed liberally to cover the invention concept to the greatest extent possible in view of this description and the pertinent prior art.

I claim:

1. A refrigeration system including a closed refrigerant loop having a condenser, a receiver, an expansion device, an evaporator, and an air cooled compressor, further comprising:

(a) means for automatically maintaining adequate head pressure of the system during colder weather, including means for backflooding the condenser or shuttling liquid refrigerant from the receiver to the condenser to maintain a desired head pressure;

(b) reservoir means for accumulating liquid refrigerant flowing between the condenser and the receiver;

(c) sensor means for sensing the level of liquid refrigerant of the reservoir means; and (d) diverting means for diverting subcooled liquid refrigerant from the condenser directly to the expansion device, thereby bypassing the receiver, the diverting means being responsive to the sensor means indicating a level of liquid refrigerant of the reservoir means above a predetermined level.

2. The refrigeration system of claim 1, the means for automatically maintaining adequate head pressure includes conduit means for providing flow of refrigerant between the outlet of the condenser and the upper portion of the receiver, the upper portion being generally above the level of liquid refrigerant in the receiver, and check valve means for limiting the flow of refrigerant in the conduit means to flow in a direction toward the receiver.

3. A control system for a refrigeration system comprising:

(a) means for automatically maintaining adequate head pressure of the system during colder weather, including means for backflooding the condenser or shuttling liquid refrigerant from the receiver to the condenser to maintain a desired head pressure;

(b) reservoir means for accumulating liquid refrigerant flowing between a condenser and a receiver;

(c) sensor means for sensing the level of liquid refrigerant of the reservoir means; and (d) diverting means for diverting subcooled liquid refrigerant from the condenser directly to an expansion device, thereby, bypassing the receiver, the diverting means being responsive to the sensor means indicating a level of liquid refrigerant of the reservoir means above a predetermined level.

4. The control system of claim 3, the means for automatically maintaining adequate head pressure includes conduit means for providing flow of refrigerant between the outlet of the condenser and the upper portion of the receiver, the upper portion being generally above the level of liquid refrigerant in the receiver, and check valve means for limiting the flow of refrigerant in the conduit means to flow in a direction toward the receiver.

5. A refrigeration system having a closed refrigerant loop, comprising:

(a) an air-cooled condenser exposed to outside ambient conditions;

(b) a receiver for separating liquid and gaseous refrigerant prior to refrigerant entering an expansion device;

(c) an expansion device;

(d) at least one evaporator;

(e) a compressor connected between the evaporator and the condenser;

(f) a bypass to direct refrigerant gas from the compressor to the receiver, the bypass including an outlet pressure regulating valve before the receiver;

(g) a refrigerant line exiting the condenser;

(h) a reservoir in the line;

(i) a three-way junction defining two flowpaths for refrigerant in the line, the first flowpath connecting the line to the expansion device, creating a bypass for subcooled liquid refrigerant from the condenser to the expansion device, the second flowpath connecting the line to the top of the receiver;

(j) a flow valve means in the first flowpath, normally closed, but openable in response to a predetermined level of liquid refrigerant in the reservoir;

(k) a check valve in the second flowpath before the receiver to prohibit flow in the second flowpath from the top of the receiver toward the junction;

(l) a shuttle line between the bottom of the receiver and the second flowpath between the junction and the check valve to allow liquid refrigerant to flow from the receiver to the condenser to maintain a desired head pressure in the condenser; and (m) a control valve means in a supply line between the receiver and the expansion device, the valve normally being open, but being closed in response to a predetermined level of liquid refrigerant in the reservoir.

6. The system of claim 5 wherein the expansion device includes an expansion valve.

7. The system of claim 5, further comprising equalizing means between the condenser and the receiver for equalizing the pressure between the condenser and the receiver during the off cycle.

8. The system of claim 5, further comprising control means, responsive to flashing in the supply line prior to the expansion device, for allowing a drop in condenser pressure when feeding subcooled liquid refrigerant to the expansion device.

9. The system of claim 8 wherein the control means includes a chamber in the first flowpath before the expansion device.

10. The system of claim 9 wherein the control means further includes a shut-off valve between the outlet pressure regulating valve of the bypass and the receiver, the shut-off valve normally being open, but closing in response to a predetermined level of liquid refrigerant in the chamber.

11. The system of claim 5, further comprising a check valve in the shuttle line to limit flow in the shuttle line to the direction from the receiver to the second pathway.

12. The system of claim 5 wherein the flow valve means and the control valve means each include a solenoid valve.

13. The system of claim 5, wherein the flow valve means and the control valve means share a thermistor means in the reservoir to detect the level of liquid refrigerant in the reservoir.

14. A refrigeration system having a closed refrigerant loop, comprising:

(a) an air-cooled condenser exposed to outside ambient conditions;

(b) a receiver for separating liquid and gaseous refrigerant prior to an expansion valve;

(c) an expansion valve connected to the receiver;

(d) an evaporator connected to the expansion valve;

(e) a compressor connected between the evaporator and the condenser;

(f) a bypass to direct refrigerant gas from the compressor to the receiver, the bypass including an outlet pressure regulating valve before the receiver;

(g) a refrigerant line exiting the bottom of the condenser, and connecting with the top of the receiver and the outlet pressure regulating valve;

(h) a reservoir in the refrigerant line;

(i) a flowpath connecting the condenser to the expansion valve, creating a bypass for subcooled liquid refrigerant from the condenser to the expansion valve;

(j) a first solenoid valve in the flowpath, normally closed, but openable in response to a predetermined level of liquid refrigerant in the reservoir;

(k) a shuttle line between the bottom of the receiver and the refrigerant line before the reservoir to allow liquid refrigerant to flow from the receiver to the condenser to maintain a desired head pressure in the condenser;

(l) a second solenoid valve in a supply line between the receiver and expansion valve, the valve normally being open, but being closed in response to a predetermined level of liquid refrigerant in the reservoir; and (m) first control means associated with the reservoir to detect the level of liquid refrigerant in the reservoir and to actuate the solenoid valves accordingly.

15. The system of claim 14, further comprising:

(a) a chamber in the flowpath before the expansion valve;

(b) a third solenoid valve between the outlet pressure regulating valve and the receiver, the valve being normally open, but closing in response to a predetermined level of liquid refrigerant in the chamber; and (c) second control means for detecting the level of liquid refrigerant in the chamber and for controlling the third solenoid valve in response to the level.

16. The system of claim 14, further comprising a check valve in the shuttle line to restrict flow in the shuttle line to the direction from the receiver to the reservoir, and a trap in the refrigerant line between the reservoir and the condenser to allow liquid refrigerant to remain in the condenser during an off cycle.

17. The system of claim 15 wherein the flowpath intersects the supply line and wherein the chamber is between the intersection and the expansion valve, so that opening of the third solenoid valve when the first solenoid valve is closed indicates that the refrigerant charge in the system is low.

18. A refrigeration system including a closed refrigerant loop having a condenser, a receiver, an expansion device, an evaporator, and a compressor, further comprising:

(a) means for automatically maintaining adequate head pressure of the system during colder weather, including means for shuttling liquid refrigerant from the receiver to the condenser to maintain a desired head pressure; and (b) means for diverting subcooled liquid refrigerant from the condenser directly to the expansion valve, thereby bypassing the receiver, the diverting means being responsive to the level of liquid refrigerant in a reservoir between the condenser and the receiver.

19. A control system for a refrigeration system comprising:

(a) means for automatically maintaining adequate head pressure of the system during colder weather, including means for shuttling liquid refrigerant from the receiver to the condenser to maintain a desired head pressure; and (b) means for diverting subcooled liquid refrigerant from the condenser directly to the expansion valve, thereby bypassing the receiver, the diverting means including a reservoir in a refrigerant line between the bottom of the condenser and the top of the receiver and means for determining a predetermined level of liquid refrigerant in the reservoir.

20. The control system of claim 19 wherein the level detection means includes a thermistor.

21. A refrigeration system having a closed refrigerant loop, comprising:

(a) an air-cooled condenser exposed to outside ambient conditions;

(b) an expansion device;

(c) a receiver for separating liquid and gaseous refrigerant prior to refrigerant entering an expansion device;

(d) at least one evaporator;

(e) a compressor connected between the evaporator and the condenser;

(f) a bypass to direct refrigerant gas from the compressor to the upper portion of the receiver, generally above the level of liquid refrigerant in the receiver, the bypass including an outlet pressure regulating valve before the receiver;

(g) a liquid refrigerant reservoir;

(h) a first refrigerant line connecting the outlet of the condenser and the reservoir;

(i) a second refrigerant line having two flowpaths for refrigerant, the first flowpath connecting the outlet of the reservoir and the expansion device, creating a path for subcooled liquid refrigerant from the condenser to the expansion device which bypasses the receiver, and the second flowpath connecting the outlet of the reservoir and the upper portion of the receiver, generally above the level of liquid refrigerant in the receiver;

(j) a third refrigerant line connecting the lower portion of the receiver, generally below the level of liquid refrigerant in the receiver, and the first flowpath, creating a supply line between the receiver and the expansion device;

(k) a sensor for sensing the level of liquid refrigerant in the reservoir;

(l) a flow valve in the first flowpath, normally closed, but openable in response to the sensor indicating a level of liquid refrigerant in the reservoir above a predetermined level; and (m) a check valve in the second flowpath before the receiver to prohibit flow in the second flowpath from the upper portion of the receiver toward the first flowpath.

22. The system of claim 21 wherein the second refrigerant line includes a three-way junction connecting the outlet of the reservoir with the first and second flowpaths.

23. The system of claim 22 wherein the third refrigerant line is connected to the second refrigerant line at a junction between the flow valve and the expansion device.

24. The refrigeration system of claim 21, wherein the condenser and the receiver are at substantially the same elevation so that static head pressure in the first and second refrigerant lines will not prevent backflooding of refrigerant from the receiver to the condensor.

25. The system of claim 21 wherein the flow valve includes a solenoid valve.

26. The system of claim 21, further comprising control means, responsive to flashing in the third refrigerant line prior to the expansion device, for allowing a drop in condenser pressure when feeding subcooled liquid refrigerant to the expansion device.

27. The system of claim 26 wherein the control means includes a chamber in the first flowpath before the expansion device, and a chamber sensor for sensing the level of liquid refrigerant in the chamber.

28. The system of claim 27 wherein the control means further includes a shut-off valve between the outlet pressure regulating valve of the bypass and the receiver, the shut-off valve normally being open, but closable in response to the chamber sensor indicating a level of liquid refrigerant in the chamber above a predetermined level.

29. A refrigeration system having a closed refrigerant loop, comprising:

(a) an air-cooled condenser exposed to outside ambient conditions;

(b) an expansion device;

(c) a receiver for separating liquid and gaseous refrigerant prior to refrigerant entering an expansion device;

(d) at least one evaporator:

(e) a compressor connected between the evaporator and the condenser;

(f) a bypass to direct refrigerant gas from the compressor to the upper portion of the receiver, generally above the level of liquid refrigerant in the receiver, the bypass including an outlet pressurse regulating valve before the receiver;

(g) a first refrigerant line having two flowpaths for refrigerant, the first flowpath connecting the outlet of the condenser and the expansion device, creating a path for subcooled liquid refrigerant from the condenser to the expansion device which bypasses the receiver, and the second flowpath connecting the outlet of the condenser and the upper portion of the receiver, generally above the level of liquid refrigerant in the receiver;

(h) a second refrigerant line connecting the lower portion of the receiver, generally below the level of liquid refrigerant in the receiver, and the first flowpath, creating a supply line between the receiver and the expansion device;

(i) a sensor for sensing the temperature of refrigerant in the first refrigerant line;

(j) a flow valve in the first flowpath, normally closed, but openable in response to the sensor indicating a temperture of refrigerant in the first refrigerant line below a predetermined temperature indicating the refrigerant in the subcooled condition.

(k) a check valve in the second flowpath before the receiver to prohibit flow in the second flowpath from the upper portion of the receiver toward the first flowpath.

30. The refrigeration system of claim 29, wherein the condenser and the receiver are at substantially the same elevation so that static head pressure in the first and second refrigerant lines will not prevent backflooding of refrigerant from the receiver to the condensor.

31. A control system for a closed refrigerant loop refrigeration system which includes an air-cooled condenser, a receiver, an expansion device, an evaporator and a compressor, comprising:

first conduit means for providing flow of refrigerant gas from the compressor to the upper portion of the receiver, generally above the level of liquid refrigerant in the receiver, the first conduit means including an outlet pressure regulating valve means for regulating the head pressure of the condenser;

second conduit means for providng flow of refrigerant between the outlet of the condenser and the upper portion of the receiver, generally above the level of liquid refrigerant in the receiver;

reservoir means in the flow of refrigerant of the second conduit means for accumulating liquid refrigerant;

sensor means for sensing the level of liquid refrigerant of the reservoir means;

check valve means for limiting the flow of refrigerant in the second conduit means to flow in a direction toward the receiver.

third conduit means for providing flow of refrigerant between the outlet of the reservoir means and the expansion device to create a path for subcooled liquid refrigerant from the condenser to the expansion device which bypasses the receiver;

valve means in the flow of refrigerant of the third conduit means for controlling the flow of refrigerant in the third conduit means, the valve means normally inhibiting the flow, but permitting the flow in response to the sensor means indicating a level of liquid refrigerant in the reservoir means above a predetermined level; and fourth conduit means for providing flow of refrigerant between the lower portion of the receiver, generally below the level of liquid refrigerant in the receiver, and the expansion device.

32. A refrigeration system including a closed refrigerant loop having a condenser, a receiver, an expansion device, an evaporator, and a compressor, further comprising:

(a) means for automatically maintaining adequate head pressure of the system during colder weather, including means for shuttling liquid refrigerant from the receiver to the condenser to maintain a desired head pressure;

(b) means for diverting subcooled liquid refrigerant from the condenser directly to the expansion valve, thereby bypassing the receiver, the diverting means being responsive to a predetermined condition of liquid refrigerant between the condenser and the receiver; and (c) means for substantially equalizing the pressure between the condenser and receiver to prevent migration of excess liquid refrigerant from the receiver to the condenser during an off cycle.

33. A refrigeration system including a closed refrigerant loop having a condenser, a receiver, an expansion device, an evaporator, and a compressor, further comprising:

(a) means for automatically maintaining adequate head pressure of the system during colder weather, including means for shuttling liquid refrigerant from the receiver to the condenser to maintain a desired head pressure;

(b) means for diverting subcooled liquid refrigerant from the condenser directly to the expansion valve, thereby bypassing the receiver, the diverting means being responsive to a predetermined condition of liquid refrigerant between the condenser and the receiver; and (c) means, responsive to flashing prior to the expansion valve, for allowing a drop in condenser pressure when feeding subcooled liquid refrigerant to the expander.

* * * * *